US006006713A

United States Patent [19]

Gebauer

[11] Patent Number: 6,006,713

[45] Date of Patent: Dec. 28, 1999

[54] HOLLOW VALVE FOR INTERNAL COMBUSTION ENGINES

[75] Inventor: Klaus Gebauer, Seelze, Germany

[73] Assignee: TRW Deutschi and GmbH, Barsinghausen, Germany

[21] Appl. No.: 09/136,356

[22] Filed: Aug. 19, 1998

[30] Foreign Application Priority Data

Aug. 19, 1997 [EP] European Pat. Off. ..... 97114254

[51] Int. Cl.[6] ..... F01L 3/20

[52] U.S. Cl. ..... 123/188.3; 123/188.8; 123/188.9

[58] Field of Search ..... 123/188.3, 188.8, 123/188.9, 188.1, 188.2, 188.6; 29/888.4, 888.44, 888.45, 888.43; 251/318

[56] References Cited

U.S. PATENT DOCUMENTS

| | | | |
|---|---|---|---|
| 4,597,367 | 7/1986 | Hayashi | 123/188.3 |
| 4,834,036 | 5/1989 | Nishiyama et al. | 123/188.2 |
| 5,047,096 | 9/1991 | Eriksson et al. | 148/325 |
| 5,413,073 | 5/1995 | Larson et al. | 123/188.3 |
| 5,458,314 | 10/1995 | Bonesteel | 251/337 |
| 5,823,158 | 10/1998 | Heiman, Jr. et al. | 123/188.3 |
| 5,843,246 | 12/1998 | Kim et al. | 148/607 |

FOREIGN PATENT DOCUMENTS

| | | |
|---|---|---|
| 0619419 B1 | 6/1997 | European Pat. Off. . |
| 896.051 | 6/1943 | France . |
| 1 283 310 | 3/1976 | France . |

*Primary Examiner*—Henry C. Yuen
*Assistant Examiner*—Hai Huynh
*Attorney, Agent, or Firm*—Collard & Roe, P.C

[57] ABSTRACT

A hollow valve for internal combustion engines, comprising a valve body having a disk, a hollow throat region and a stem component, wherein the valve body is designed in the form a deep-drawn metal part made of austenitic metal. There is a stem end piece welded to the stem component of the valve body and a cover welded to the disk. The valve body, end piece and cover enclose a hollow space extending from the stem end piece into the disk. This valve is considerably lighter in weight than traditional valves, and is capable of lowering the temperature of the valve when the hollow space is filled with a coolant.

6 Claims, 2 Drawing Sheets

HOLLOW VALVE FOR INTERNAL COMBUSTION ENGINES

BACKGROUND OF THE INVENTION

1. Field of the Invention

This invention relates to a hollow valve for internal combustion engines. In particular, the invention relates to a hollow valve that is capable of reducing the temperature of the valve and is lighter in weight.

2. The Prior Art

Hollow valves represent a particular type of design of outlet valves that are subject to higher stress. Such valves are used for lowering the temperature in the region of the hollow throat and the valve disk, but also to reduce the weight of the valve. When hollow valves are used for lowering the temperature, the hollow space is filled with metallic sodium up to about 60% of its volume. The sodium transports the heat from the head to the stem of the valve, where it is t hen discharged via the valve guide.

Several hollow valve variations are known. With one of such variations, the basic body is drilled hollow and then joined with a massive end piece of the shaft by friction welding. The end piece of the shaft can be hardened and therefore permits stabilization that is adapted to stress.

Another variation is substantially more expensive to manufacture. This basic body is drilled from the end of the shaft as well. However, the bore is sealed by inductive heating of the end of the shaft with subsequent closing of the bore by forging. The massive end piece of the shaft is attached by friction welding. Friction welding of the massive end of the shaft with the closure of the end of the basic body offers higher safety. This type of design is used predominantly in high performance engines.

The optimum weight reduction and heat discharge from the surface of the valve disk has previously been achieved by a hollow head valve. In contrast to the above mentioned designs, such a valve is drilled and worked from the disk side. The aperture is sealed by inserting a lid or cover. The application of such valves is predominantly limited to the field of motor sports, as their complicated manufacture leads to high costs. To avoid subjecting the valve shaft seals to excessive temperatures, however, the bore of the valve may extend only up to the proximity of the sealing lip of the elastomeric valve shaft seal extending on the outer diameter. A longer bore can be drilled only if no valve shaft seal is used.

Hollow valves may be manufactured as mono-metal valves. However, bimetal valves are more common. In these valves, the stem consists of a ferritic-martensitic steel and the head consists of austenitic material or a nickel-based material. This material is shaped hot as the head piece is being manufactured before it is drilled hollow.

European Patent No. EP 0 619 419 B1 discloses that the manufacture of very light valves is known. This type of valve is manufactured as a single piece, hollow cylindrical component from a ductile metal sheet material. These valves, however, are mono-metal valves that can only be used in lower stress environments, because austenitic material has heretofore been excluded from cold-forming processes. Furthermore, in the known valve having a deep-drawn valve body, the hollow space extends up to the outermost end of the shaft. The discharge of heat through a valve filling, if any is used into the end piece of the stem, however, could be damaging under certain circumstances. The use of such valves for lowering the temperature is very questionable, especially with valves having valve guides with a terminal sealing of the valve shaft.

SUMMARY OF THE INVENTION

It is therefore an object of the present invention to provide a hollow bimetal valve of very low mass that has a high mechanical resistance to wear and resistance to high-temperature corrosion. It is another object of the present invention to provide a hollow bimetal valve that is economical to manufacture.

These and other objects are accomplished by a hollow valve comprising three components joined together by welding. The components comprise a stem end part, a valve body and a cover. The valve body comprises a stem part, a hollow throat portion and a disk. The stem end part is welded to the stem part of the valve body and the cover is welded to the disk. The components enclose a hollow space that extends from the region of the disk of the valve body into the valve stem. The valve body extending from the end of the stem into the region of the disk is designed in the form of a deep-drawn sheet metal part made of austenitic material. This part is joined to the stem end part by welding. The stem end part is drilled hollow to reduce the weight of the valve.

The successful application of an austenitic material, which was previously considered unsuitable for deep-drawing in producing a valve body in the form of a deep-drawn sheet metal part, came as a great surprise to experts in the field.

An inner bead or welding flash is produced as large as possible on the welding seam in the welding operation. This inner bead either completely or partially seals the connection between the drilled hollow space in the end part of the stem and the hollow space in the valve body. The coolant present in the valve body is thus prevented from penetrating the hollow space of the end part of the shaft, and the valve shaft seal at the end of the valve guide is protected against damage caused by excessively high temperatures. The hollow space in the stem end part thus only serves to reduce the weight of the valve.

The cover that closes the disk region is preferably connected to the valve body by the casing of the valve seat. The manufacturing process is thereby simplified and economical production is ensured, even though the valve consists of three components. Designing the valve body as a deep-drawn component permits a variation of the wall thickness in an economically favorable manner, and thus permits an adaptation to the stress requirements. For example, the wall thickness could be made larger in the region of high stresses.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
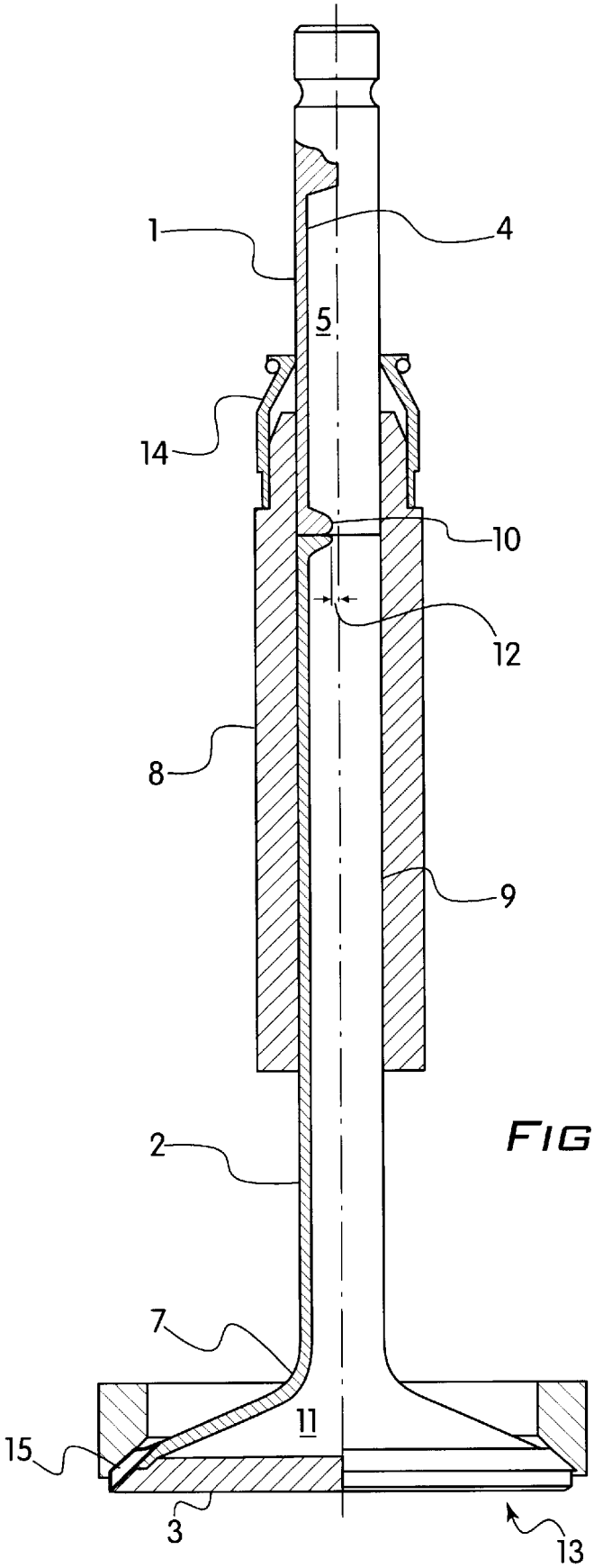
FIG. 1 shows a longitudinal section through the valve according to the invention.
Figure 2:
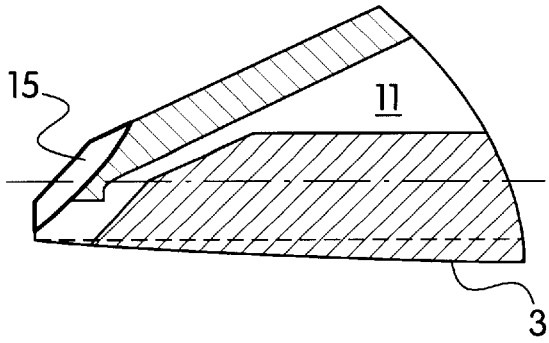
FIGS. 2–5 show several variations of the connection points between the cover and the valve body with the valve according to the invention.
Figure 3:
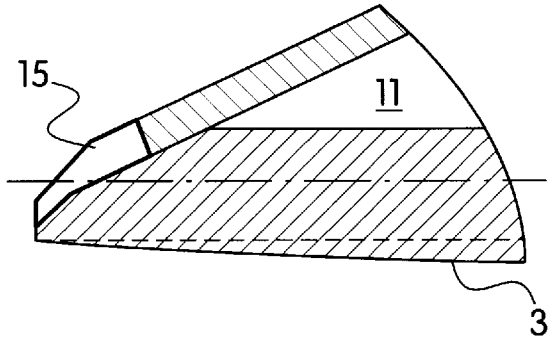
Figure 4:
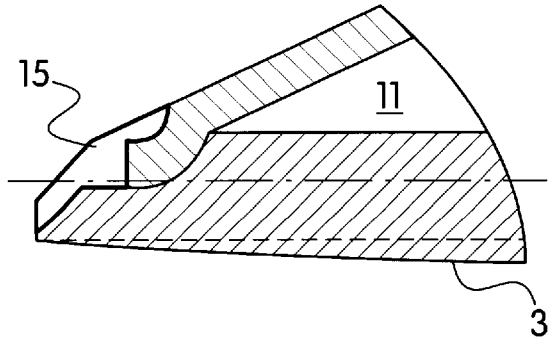
Figure 5:
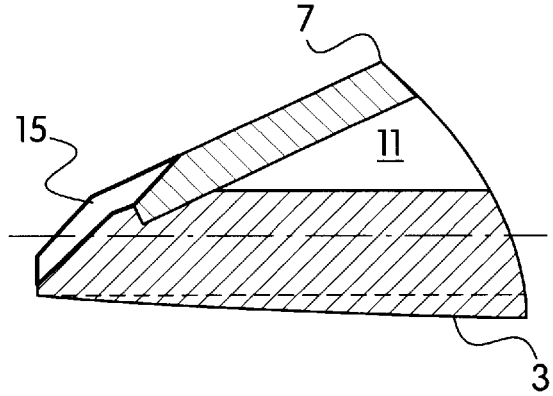

Referring now in detail to the drawings and, in particular, FIG. 1, there is shown the valve according to the invention, which consists of three components: valve stem end piece 1, valve body 2 and cover 3. Stem end part 1 is provided with a bore 4 in order to increase the hollow space 5. Valve body 2, which has a disk, a hollow throat region 7 and a stem component 9 extending into the valve guide, is a deep-drawn structural part. Stem end piece 1, on the other hand, is a separate part that is manufactured in the commonly employed way from a ferritic-martensitic material. Valve end piece 1 and valve body 2 are preferably joined together by friction welding, forming an inner bead 10, which reaches far inwardly.

The hollow space is divided in this process into sections 5 and 11, whereby a small passage cross section 12 may be preserved. Thus, it is impossible for coolant present in hollow space 11 of valve body 2 to enter hollow space 5 of stem end piece 1 in significant amounts. Thus, hollow space 5 serves only to reduce the weight of the valve. The heat conducted from valve disk 13 via the coolant into the shaft of the valve body is adequately transferred to guide 8 and discharged from there via the water circulation in the cylinder head. Shaft seal 14 starting on the end of the valve guide is thus protected against destruction due to excessive heat.

As shown in FIGS. 2–5, the valve head is sealed in the region of disk 19 by a cover 3. Seat casing 15 serves as a connection element between cover 3 and the valve body.

Accordingly, while only a few embodiments of the present invention have been shown and described, it is obvious that many changes and modifications may be made thereunto without departing from the spirit and scope of the invention.

What is claimed is:

1. A hollow valve for internal combustion engine for reducing the weight and temperature of the valve, comprising:

a valve body having a disk, a hollow throat region and a stem component, said valve body being designed in the form of a deep-drawn metal part made of austenitic metal;

a stem end piece welded to the stem component of the valve body;

a cover welded to the disk said valve body, end piece and cover enclosing a hollow space extending from the end piece into the disk; and an inner bead at least partially enclosing a cross section of the hollow space at a seam where the stem and piece is welded to the stem component of the valve body.

2. The hollow valve according to claim 1, further comprising an inner bead at least partially enclosing a cross section of the hollow space at a seam where the stem end piece is welded to the stem component of the valve body.

3. The hollow valve according to claim 1, wherein the stem end piece is drilled hollow.

4. The hollow valve according to claim 1, wherein the stem end piece is comprised of a ferritic-martensitic material.

5. The hollow valve according to claim 1, wherein the deep-drawn metal sheet part of the valve body has an area of greater wall thickness in a region subject to high stresses.

6. The hollow valve according to claim 1, further comprising a cover closing the valve disk, said cover being welded to the disk through a seat casing.

* * * * *

UNITED STATES PATENT AND TRADEMARK OFFICE

CERTIFICATE OF CORRECTION

PATENT NO. : 6,006,713
DATED : December 28, 1999
INVENTOR(S) : GEBAUER

It is certified that error appears in the above-indentified patent and that said Letters Patent is hereby corrected as shown below:

On the title page, column 1, Item [73], change the name of the assignee to read

---TRW Deutschland GmbH-- and,

In column 4, lines 17-20, delete these lines in their entirety (claim 2).

Signed and Sealed this

Twenty-third Day of January, 2001

*Attest:*

*Attesting Officer*

Q. TODD DICKINSON

*Commissioner of Patents and Trademarks*